US005586879A

United States Patent [19]

Szpak

[11] Patent Number: 5,586,879

[45] Date of Patent: Dec. 24, 1996

[54] FLUORESCENT ELECTROLUMINESCENT LAMP

[75] Inventor: Archana Szpak, Canton, Mich.

[73] Assignee: Ford Motor Company, Dearborn, Mich.

[21] Appl. No.: 575,267

[22] Filed: Dec. 20, 1995

Related U.S. Application Data

[62] Division of Ser. No. 270,331, Jul. 5, 1994, abandoned.

[51] Int. Cl.[6] ..... H05B 33/02

[52] U.S. Cl. ..... 445/24; 362/293

[58] Field of Search ..... 445/24; 362/293, 362/260

[56] References Cited

U.S. PATENT DOCUMENTS

| | | | |
|---|---|---|---|
| 2,594,903 | 4/1952 | Freedman et al. . | |
| 3,560,784 | 2/1971 | Steele et al. | 313/112 X |
| 3,652,956 | 3/1972 | Pinnow et al. | 332/7.51 |
| 4,020,389 | 4/1977 | Dickson et al. | 313/112 X |
| 4,035,686 | 7/1977 | Fleming . | |
| 4,761,715 | 8/1988 | Brooks . | |
| 4,766,526 | 8/1988 | Morimoto et al. | 362/255 |
| 4,779,166 | 10/1988 | Tanaka et al. . | |
| 4,874,224 | 10/1989 | Gutman et al. | 350/174 |
| 4,954,747 | 9/1990 | Tuenge et al. | 313/112 X |
| 4,989,956 | 2/1991 | Wu et al. . | |
| 4,991,064 | 2/1991 | Clem | 362/27 |
| 5,049,780 | 9/1991 | Dobrowolski et al. | 313/112 X |
| 5,055,739 | 10/1991 | Thioulouse | 313/112 X |
| 5,117,334 | 5/1992 | Kameda . | |
| 5,128,846 | 7/1992 | Mills et al. . | |
| 5,130,548 | 7/1992 | Sano | 250/461.1 |
| 5,131,877 | 7/1992 | Mathumoto | 445/24 |
| 5,142,274 | 8/1992 | Murphy et al. | 340/705 |
| 5,162,160 | 11/1992 | Matsui et al. | 428/690 |
| 5,211,467 | 5/1993 | Seder | 362/293 X |
| 5,223,814 | 6/1993 | Suman | 340/525 |
| 5,227,773 | 7/1993 | Wu et al. . | |
| 5,232,388 | 8/1993 | Danjell | 445/22 |
| 5,239,228 | 8/1993 | Taniguchi et al. | 313/112 X |
| 5,257,167 | 10/1993 | Clem | 362/27 |
| 5,504,661 | 4/1996 | Szpak | 362/30 |

FOREIGN PATENT DOCUMENTS

| | | |
|---|---|---|
| 0323217A1 | 7/1989 | European Pat. Off. . |
| 0376038A1 | 7/1990 | European Pat. Off. . |
| 0581232A1 | 2/1994 | European Pat. Off. . |
| 0609110A1 | 8/1994 | European Pat. Off. . |
| 4203014A1 | 8/1992 | Germany . |
| 52-20796 | 2/1977 | Japan . |
| 2094051 | 9/1982 | United Kingdom . |

OTHER PUBLICATIONS

Database WPI, Section Ch, Week 9531, Derwent Publicstions Ltd., London, GB; Class A85, AN 95-234976.

Database WPI, Section CH, Week 9110, Derwent Publications Ltd., London, GB; Class A85, AN 91-067947.

Shift, The Journal of Automotive Innovation, Issue 1, 1994, Chris Shol, Go-Anywhere Lighting, pp. 20-21.

Encyclopedia of Electronics and Computers, Light Panel, Sybil P. Parker, pp. 459-460, 1984.

*Primary Examiner*—Kenneth J. Ramsey

*Attorney, Agent, or Firm*—Mark Mollon

[57] ABSTRACT

A lamp panel provides a light source employing dual light producing mechanisms. Specifically, electroluminescence produces a source light which is passed through a translucent fluorescent filter that modifies the color spectrum to a desired color. The use of dual light producing mechanisms allows optimization of electroluminescent lamp durability and luminesce without regard to the final color desired. The light from the optimized EL lamp is converted to any desired color using an appropriate fluorescent pigment or mixture of fluorescent pigments.

1 Claim, 2 Drawing Sheets

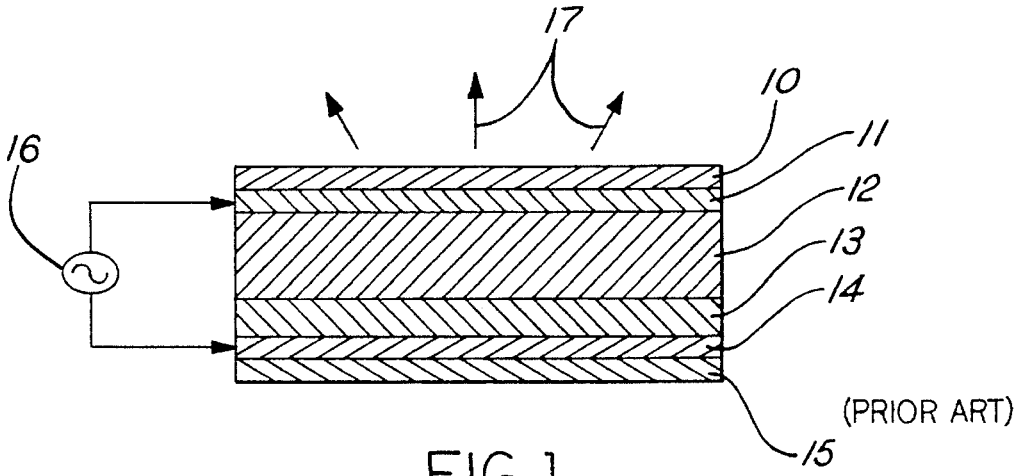
FIG. 1
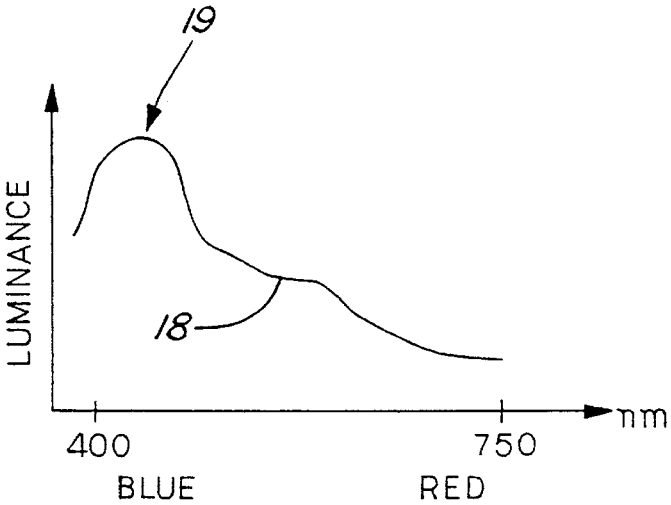
(PRIOR ART)
FIG. 2
FIG. 3
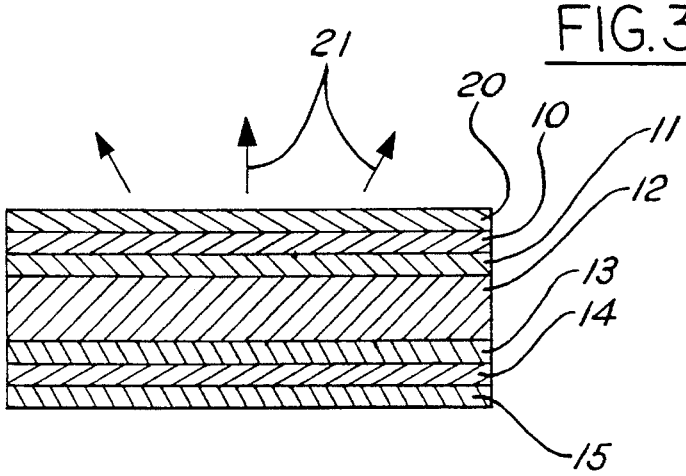

FLUORESCENT ELECTROLUMINESCENT LAMP

This application is a Divisional Application of U.S. application Ser. No. 08/270,331, filed Jul. 5, 1994, now abandoned.

BACKGROUND OF THE INVENTION

This application is related to co-pending application Ser. No. 08/270,563 entitled "Translucent Fluorescent Filter For Display Panels", filed concurrently with this application which is incorporated herein by reference.

The present invention relates in general to electroluminescent lamp panels, and more specifically to the use of fluorescence to modify the color spectrum of light emitted by the electroluminescence of the lamp panel.

An electroluminescent (EL) panel typically comprises a microencapsulated phosphor contained between two conductive plates. One plate is transparent to pass light generated when the plates are charged with an AC voltage. EL has advantages of small size (it is very thin) and an ability to selectively backlight desired areas of control panels without complicated light baffles or light pipes. One limitation of EL is that its luminance level or brightness tends to be lower than that achievable with other sources unless high voltage levels or frequencies are applied. Furthermore, the brightness achievable at a particular voltage and frequency depends on the color of light produced. Phosphors formulated for producing blue light have achieved higher brightness than for other colors (especially red) or blends of colors. Thus, brightness from an EL lamp panel has been approximately directly proportional to the frequency of light produced.

Although brightness can be generally increased by applying a higher voltage or a higher frequency to the EL lamp panel, voltage is limited in automotive systems unless expensive converters are used. Higher voltages also create more stress in the phosphor layer, reducing the lifetime and durability of the EL lamp. In addition, higher frequencies are undesirable because of increased electromagnetic radiation.

In view of the foregoing factors, lamp durability, brightness, and the colors of light obtainable have been subject to various trade-offs.

SUMMARY OF THE INVENTION

The present invention has the advantage of providing a predetermined color spectrum in an electroluminescent lamp without requiring trade-offs in lamp durability, electromagnetic radiation, or luminance as in the prior art.

The present invention has the further advantage that an EL lamp can be optimized for brightness and durability without regard to the final color of light to be produced. Later, a previously constructed EL panel can be coated with a translucent fluorescent filter for providing the desired colors.

These and other advantages and objects are achieved in a method of producing visible light from a light panel having a predetermined color spectrum. A time-varying electric field is applied to an electroluminescent material comprising phosphor resulting in the emission of light having a first color spectrum different from the predetermined color spectrum. The light from the electroluminescent material is passed through a translucent fluorescent filter comprising fluorescent pigments for absorbing incident light at at least one selected frequency and re-emitting light at at least one other selected frequency, whereby light emerging from the fluorescent filter has the predetermined color spectrum.

BRIEF DESCRIPTION OF THE DRAWINGS

FIG. 1 is a cross-sectional view of a conventional electroluminescent (EL) lamp structure.

FIG. 2 plots the color spectrum of an EL lamp according to FIG. 1.

FIG. 3 is a cross-sectional view of the fluorescent electroluminescent (FEL) lamp of the present invention.

DETAILED DESCRIPTION OF THE PREFERRED EMBODIMENTS

Figure 4:
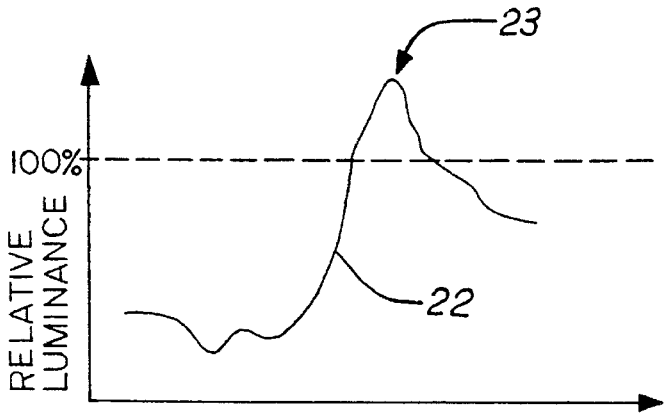
FIG. 4 is a plot showing the relative luminance of white light passing through a translucent fluorescent filter.

A cross-section through a conventional EL lamp is shown in FIG. 1. A clear substrate layer 10 supports the EL lamp. Each succeeding layer is deposited over the preceding layers to form an EL lamp as follows. A transparent electrode 11 adheres over clear substrate layer 10. Transparent conductor 11 may comprise ITO material, for example. An electroluminescent phosphor layer 12 is deposited over transparent conductor 11 and comprises a phosphor that generates electroluminescent light in the presence of a reversing electric field. Phosphor layer 12 may be comprised of microencapsulated phosphor particles in a carrier matrix, as employed in EL lamps sold by Durel Corporation.

A dielectric layer 13 is deposited over phosphor layer 12 and supports a second electrode formed by a carbon layer 14. An ultraviolet-curable hardcoat layer 15 is deposited over carbon electrode layer 14 to provide mechanical protection and electrical insulation.

An alternating voltage source 16 is connected between transparent electrode layer 11 and carbon electrode layer 14. An alternating voltage creates an alternating electric field across phosphor layer 12 resulting in the emission of electroluminescent light 17 passing through transparent electrode layer 11 and clear substrate layer 10.

Many different mixtures are known for use in the phosphor layer, such as zinc sulfide with small amounts of impurities such as copper or manganese. Depending on the phosphor mixture and the voltage and frequency of the applied AC voltage, an electroluminescent light spectrum will be produced as shown in FIG. 2. A color spectrum 18 shows the total luminarice at each visible frequency between about 400 and 750 nm.

Phosphor mixtures corresponding to maximum efficiency (i.e., luminance for a given applied voltage) and durability (i.e., long lamp life) have been ones that produce light at the blue end of the spectrum when the optimum voltage and frequency are applied. For example, color spectrum 18 in FIG. 2 shows a substantial component 19 within blue light. In the prior art, compromises have been made in brightness, efficiency, durability, and/or electromagnetic interference in order to provide substantial components of the light spectrum at the lower (i.e., red) end of the visible light spectrum.

The present invention utilizes an optimized EL lamp to produce light having a substantial component at colors other than the blue produced by the optimized EL lamp. Thus, a translucent fluorescent filter layer 20 is deposited on clear substrate layer 10 as shown in FIG. 3. Electroluminescent light from phosphor layer 12 passes through translucent fluorescent filter layer 20 and has its spectrum modified to include a substantial component at a different frequency by absorption and re-emission of light by fluorescence. Light 21 emitted from the fluorescent electroluminescent (FEL) lamp has a predetermined color spectrum different from the first color spectrum emitted by the optimized EL lamp structure.

Figure 5:
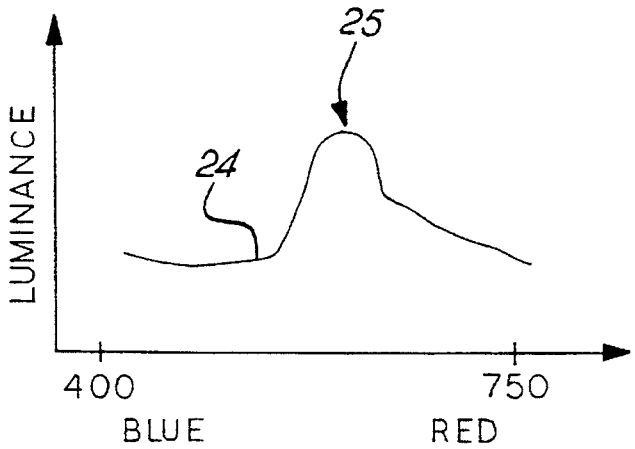
FIG. 5 is a plot showing the modified color spectrum of the FEL lamp of FIG. 3.

The translucent fluorescent filter has a light characteristic as shown in FIG. 4. A horizontal line at 100% relative luminance represents pure white light directed toward the translucent fluorescent filter. The resulting relative luminance emerging from the translucent fluorescent filter is shown as curve 22. Curve 22 shows attenuation at some light frequencies. However, at fluorescence, a luminarice is produced greater than the incident light level as shown at substantial component 23 in the resulting light spectrum. A translucent fluorescent filter with the characteristic of FIG. 4 would convert the first color spectrum of FIG. 2 into the color spectrum shown in FIG. 5, where a curve 24 has a substantial component 25 at a color having a longer wavelength (lower frequency) than blue light, such as green. Different fluorescent pigments can be employed to convert the blue electroluminescent light into substantially any color having a longer wavelength.

The translucent fluorescent filter of the present invention is preferably applied to the outer surface of an EL lamp in the form of a screenable fluorescent ink. Thus, the clear substrate of the EL lamp is coated by a mixture of a fluorescent pigment and a matrix material. The matrix material is selected to provide proper adherence with the material of the clear substrate. For example, the clear substrate may preferably be comprised of a polyester material. The selected matrix material would be also based on a polyester in order to adhere during the silk screening process. Selection of a matrix material is known in the art depending upon the substrate material.

Screenable fluorescent inks have been successfully used according to the following examples.

A red fluorescent ink was formulated comprising 66 ⅔ weight percent of ink base solids and 33 ⅓ weight percent of fire-orange fluorescent pigment. The fluorescent pigment was designated GT-14-N supplied by Dayglo Color Corp.

A fluorescent ink for providing amber light was formulated of a clear ink matrix contributing 90 weight percent and Arc Yellow fluorescent pigment contributing 10 weight percent.

Mixtures of different fluorescent pigments or mixtures of fluorescent pigments with non-fluorescent pigments may be utilized to obtain silk screen inks of various hues (i.e., any predetermined spectrum of light).

Figure 6:
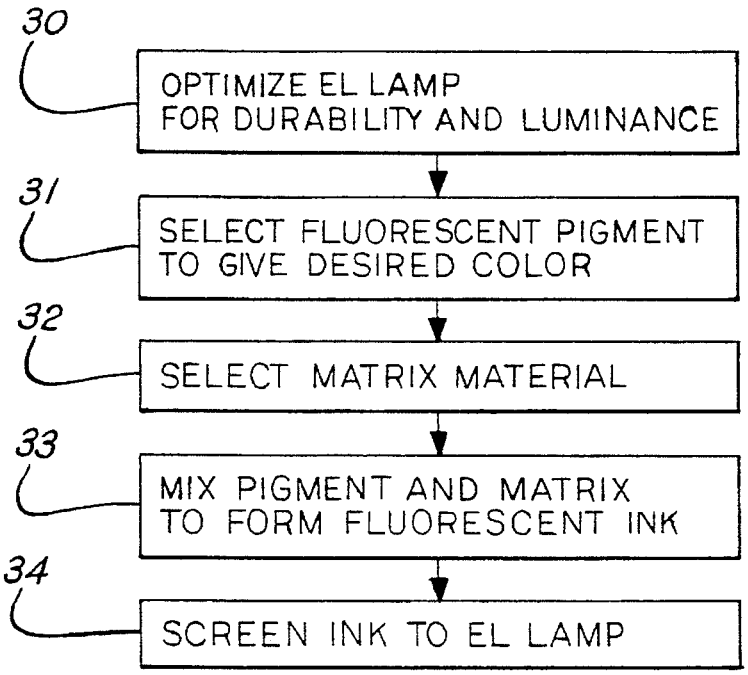
FIG. 6 is a flow chart showing a production process of the present invention.

The present invention allows a single electroluminescent lamp structure to be utilized in providing illumination of various colors. The standard EL lamp can be manufactured and then modified by application of a fluorescent ink to provide a desired color spectrum. As shown in FIG. 6, an EL lamp is optimized for durability and luminance in step 30. A fluorescent pigment is selected in step 31 to give a desired color based on the source EL spectrum provided from electroluminescence and the available fluorescent pigments to modify the spectrum by absorbing a portion of the light of the EL spectrum and re-emitting light by fluorescence at a different frequency to produce a modified spectrum. Based on the substrate material of the EL lamp and the fluorescent pigment selected, a matrix material is selected in step 32. The pigment and matrix material are mixed in step 33 to form a fluorescent ink. Finally, the fluorescent ink is screened to the EL lamp in step 34 to produce the fluorescent-electroluminescent (FEL) lamp.

What is claimed is:

1. A method of providing an electroluminescent lamp structure comprising the steps of:

providing an electroluminescent lamp having a phosphor selected to optimize lamp durability and luminance without regard to the color of light produced by said phosphor;

selecting a fluorescent pigment to modify light produced by said phosphor in said optimized electroluminescent lamp to a desired color by absorbing a portion of light emitted by said phosphor and re-emitting light by fluorescence to produce said desired color;

mixing said selected fluorescent pigment with a matrix material to form an ink; and applying said ink to said electroluminescent lamp.

* * * * *